US009593841B2

(12) United States Patent
Sutton

(10) Patent No.: US 9,593,841 B2
(45) Date of Patent: Mar. 14, 2017

(54) LIGHT-UP CUP

(71) Applicant: CUDLIE ACCESSORIES, INC., New York, NY (US)

(72) Inventor: Paul Sutton, Brooklyn, NY (US)

(73) Assignee: CUDLIE ACCESSORIES, INC., New York, NY (US)

( * ) Notice: Subject to any disclaimer, the term of this patent is extended or adjusted under 35 U.S.C. 154(b) by 0 days.

(21) Appl. No.: 14/680,635

(22) Filed: Apr. 7, 2015

(65) Prior Publication Data

US 2015/0292729 A1 Oct. 15, 2015

Related U.S. Application Data

(60) Provisional application No. 61/979,283, filed on Apr. 14, 2014.

(51) Int. Cl.

| | |
|---|---|
| ***F21V 33/00*** | (2006.01) |
| ***F21V 23/04*** | (2006.01) |
| ***A47G 19/22*** | (2006.01) |
| ***F21Y 101/00*** | (2016.01) |

(52) U.S. Cl.

CPC ..... *F21V 33/0024* (2013.01); *A47G 19/2227* (2013.01); *F21V 23/0492* (2013.01); *A47G 2019/2238* (2013.01); *F21Y 2101/00* (2013.01)

(58) Field of Classification Search

CPC ..... A47G 2019/2238; F21V 23/0492; F21V 23/0442; F21V 33/0024

USPC ..... 362/101, 96

See application file for complete search history.

(56) References Cited

U.S. PATENT DOCUMENTS

| | | | | |
|---|---|---|---|---|
| 2,663,866 | A | 12/1953 | Simpson | |
| 5,070,435 | A | 12/1991 | Weller | |
| 5,119,279 | A | 6/1992 | Makowsky | |
| 5,171,081 | A | 12/1992 | Pita et al. | |
| 5,211,699 | A * | 5/1993 | Tipton | 362/101 |
| 5,662,406 | A | 9/1997 | Mattice et al. | |
| 5,785,407 | A * | 7/1998 | Ratcliffe | A47G 19/2227 362/101 |
| 6,158,870 | A * | 12/2000 | Ramirez | A61J 9/06 215/11.1 |

(Continued)

FOREIGN PATENT DOCUMENTS

| | | |
|---|---|---|
| CN | 201082078 Y | 7/2008 |
| CN | 203001465 | 6/2013 |

(Continued)

OTHER PUBLICATIONS

Keyring Store, Baby Bottle-style LED torch keyring, www.keyringstore.com, pp. 1-2, Bedford, United Kingdom.

(Continued)

*Primary Examiner* — Peggy Neils
*Assistant Examiner* — William N Harris
(74) *Attorney, Agent, or Firm* — Gottlieb, Rackman & Reisman, P.C.

(57) ABSTRACT

A closed cup for dispensing comestible products, such as drinks for babies and infants, includes a double walled body and a top. An electronic assembly is disposed between the two walls of the body and includes one or more light sources arranged to emit light through the body sidewall. An event sensor, such as an accelerometer, senses when a certain event is taking places, for example, the cup is shaken, causing the light source(s) to be activated.

18 Claims, 3 Drawing Sheets

(56) References Cited

U.S. PATENT DOCUMENTS

| | | | | |
|---|---|---|---|---|
| 6,238,263 | B1 | 5/2001 | Bennett | |
| 6,254,247 | B1 | 7/2001 | Carson | |
| 6,443,589 | B1 | 9/2002 | Lee | |
| 6,474,467 | B1 | 11/2002 | Kurdian | |
| 6,511,196 | B1 * | 1/2003 | Hoy | A47G 19/2227 362/101 |
| 6,511,197 | B1 | 1/2003 | Kalemjian | |
| 6,591,524 | B1 * | 7/2003 | Lewis et al. | 40/324 |
| 6,676,269 | B1 | 1/2004 | Dorney | |
| 6,921,179 | B2 | 7/2005 | Diak Ghanem | |
| 7,824,627 | B2 | 11/2010 | Michaels et al. | |
| 8,480,248 | B2 * | 7/2013 | Demarest et al. | 362/96 |
| 8,579,459 | B2 * | 11/2013 | Ma | A45C 3/00 362/156 |
| 8,633,454 | B2 | 1/2014 | Durkin | |
| 2003/0076671 | A1 | 4/2003 | Diak Ghanem | |
| 2003/0090892 | A1 * | 5/2003 | Su | 362/101 |
| 2004/0202751 | A1 | 10/2004 | McKay et al. | |
| 2004/0246705 | A1 * | 12/2004 | Lu | A47G 23/0309 362/101 |
| 2005/0207141 | A1 * | 9/2005 | Boesch et al. | 362/101 |
| 2006/0062085 | A1 * | 3/2006 | Evans | 368/10 |
| 2007/0014100 | A1 | 1/2007 | Perez et al. | |
| 2009/0321458 | A1 | 12/2009 | Blair et al. | |
| 2013/0271963 | A1 | 10/2013 | Zalon | |
| 2014/0022768 | A1 | 1/2014 | Midence | |
| 2014/0300273 | A1 * | 10/2014 | LeBrun et al. | 315/76 |

FOREIGN PATENT DOCUMENTS

| | | |
|---|---|---|
| DE | 202004006375 | 6/2004 |
| WO | WO2010087560 | 8/2010 |
| WO | WO2010100406 | 9/2010 |

OTHER PUBLICATIONS

Wulla, Infant Baby Bottle Blue or Red Night Light-Lamp Boy Girl LED-Nursery Shower Gift, pp. 1-2, www.luulla.com.

Sellwell (Group) LED Craft Factory, LED flashing light up cup for bar supply LED-SW-011, www.ledexcite.com, p. 1, Hunan, China.

wellpromo.com, China Promotional Products Wholesale, Wholesale—20 Oz. 3-light Cowboy Boot Mug With Red, Blue & Green Led Light, www.sz-wholesale.com, pp. 1-2, Shenzhen, China.

International Search Report (ISR) mailed by the Israel Patent Office in its capacity as the International Searching Authority on Aug. 11, 2015 in the counterpart International Application No. PCT/US15/24923.

* cited by examiner

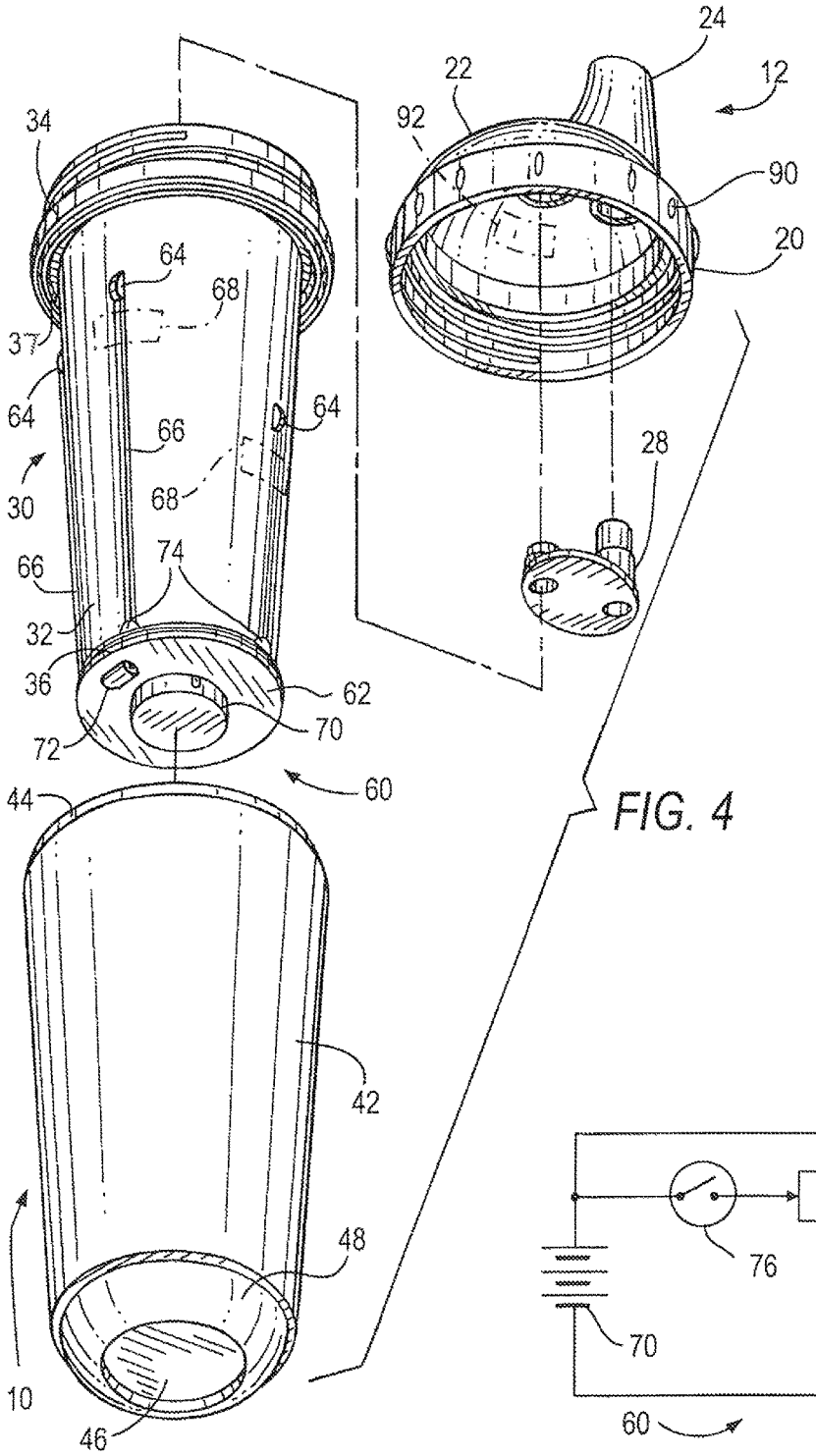
FIG. 4
FIG. 5
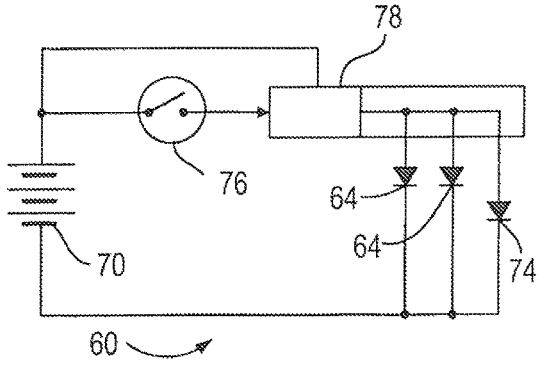

LIGHT-UP CUP

RELATED APPLICATIONS

This application claims priority to U.S. Provisional Patent application Ser. No. 61/979,283 filed on Apr. 14, 2014 and incorporated herein in its entirety.

BACKGROUND OF THE INVENTION a. Field of Invention

This invention pertains to a cup that lights up when certain events take place, such as when the cup is put down or is knocked by a hard object.

b. Field of Invention

Drinking cups are very popular especially for babies, infants, toddlers and even older children. They are the preferred means of providing liquids at any time of the day or night. Most drinking cups for children are available as an assembly of a lower portion forming a receptacle for the liquids. These lower portions are frequently double walled to provide thermal insulation to the cup contents, to make the lower portion stronger, etc. The assembly typically further includes a lid used to close securely to make the cup somewhat spill proof. The lid is provided with a spout through which a child can drink the cup contents. A valve may be provided in the spout or elsewhere in the lid to insure that the contents of the cup don't spill if the cup is shaken, turned over or otherwise disturbed. These types of cups have become known as "sippy cups" and are widely available from different manufacturers.

Most sippy cups have decorations in form of painted figures or other artwork on the sidewalls of the lower portion and the top surface of the lid. The purpose of these decorations is to attract attention of the child while in use. Unfortunately, in today's busy environment, the sippy cups must vie for the child's attention with many other devices, such as TVs, lights, cell phones, toys and various other electronic devices all which generate dynamic, sharp, colorful, flashy images at the child. In many situations, with all this excitation around the child, the child quickly loses attention and interest in conventional sippy cups and fails to drink their contents.

The present invention overcomes these problems and presents a drinking cup that is attractive and holds the attention of children longer.

SUMMARY OF THE INVENTION

An illuminated cup or container constructed in accordance with this invention includes a top, and a preferably double-walled body cooperating with said top to define a main cavity selectively holding a comestible product, such as a drink for a baby or infant. The body includes an outer wall made of a translucent material.

An electronic assembly is also provided that includes at least a first plurality of light sources disposed in the intermediate cavity formed between the walls of the body, and a power supply selectively activated to provide power to the light sources causing said light sources to light up and become visible outside said body.

Preferably, the electronic assembly includes an event sensor sensing a predetermined event, the event sensor controlling the activation of said light sources.

Preferably, a timer is provided within the body that is coupled to the event sensor and is responsive to said event sensor to activate said light sources.

The electronic assembly further comprises a second plurality of light sources selectively powered by said power supply, the second plurality of light sources being disposed at the bottom of the body. When these light sources are activated, they are also visible through an outer wall of the body.

In one embodiment, the light sources are activated simultaneously by the timer.

In one embodiment, the light sources are activated in a predetermined sequence.

Preferably, the event sensor is an accelerometer adapted to sense a particular motion of the body for example, when the body is shaken or placed on a relatively hard surface.

In one embodiment, the cup includes a top and a double walled body, the body including a main cavity for receiving and holding a comestible product, such as a drink for a baby or infant, and an intermediate cavity formed between the walls. The intermediate cavity includes an upper section that is generally frustoconical and is used to hold the various light sources mentioned above. The light sources may be supported by the wires that also provide power to the light sources. Alternatively, the light sources are attached to one of the walls of the intermediate cavity.

The bottom portion of the intermediate cavity is generally disc shaped and is arranged to receive and hold a disc shaped printed circuit board. A battery is attached or supported by the printed circuit board and provides power for the light sources.

Also attached to the printed circuit board is the timer and the event sensor switch. The timer and the event sensor switch can be bundled on the printed circuit board as a single integrated circuit (IC) chip.

DESCRIPTION OF THE DRAWINGS

FIG. 4 shows a blown-up view of the cup of FIGS. 1-3; and

FIG. 5 shows an electrical diagram illustrating how the light sources are powered and activated.

DETAILED DESCRIPTION

Figure 1:
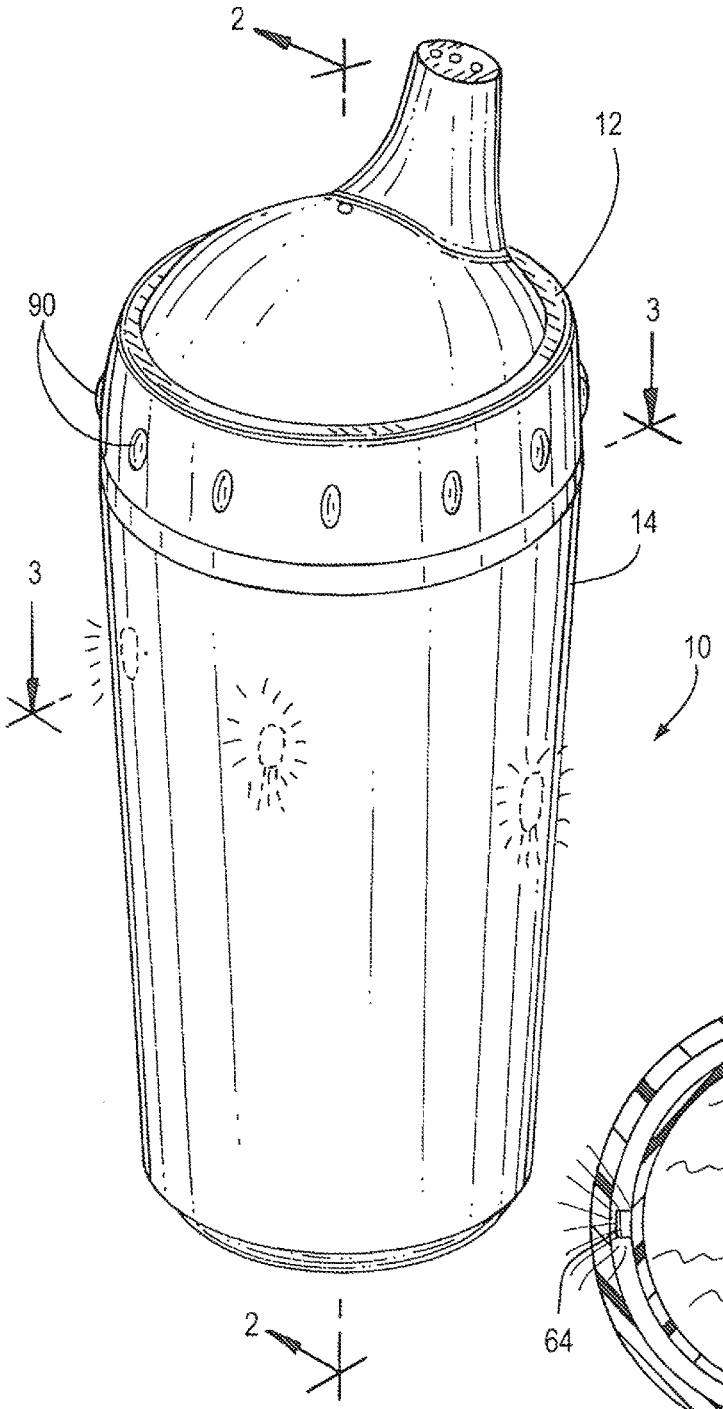
FIG. 1 shows an isometric front view of a cup constructed in accordance with this invention.

As shown in the Figures, a drinking cup 10 constructed in accordance with this invention includes a lid 12 and a body 14. These elements cooperate to form a container for an comestible product 33.

The lid 12 includes a generally cylindrical lower portion 20, a dome 22 and a spout 24. The spout 24 forms a channel 26 through which the contents of the body 12 can be dispensed (such as a comestible product 33—see FIG. 2). As mentioned above, a conventional valve 28 may also be provided in the spout 24. The valve prevents the contents of the cup 10 should the cup be turned over or shaken, a fairly common occurrence around young children.

The body 14 includes an inner member 30 and an outer member 40. The two members 30, 40 are preferably colored either uniformly or with various esthetic designs. In addition, outer member 40 or both members 30, 40 are transparent or at least translucent.

The inner member 30 is formed with a cylindrical or frustoconical side wall 32 with a ring-shaped portion 34 and a somewhat flat bottom surface 36. Wall 32 includes an inner surface 32A and an outer surface 32B.

The ring shaped portion 34 is adapted to engage the lower portion 20 of top 12 and form therewith a substantially spill proof container. For example, the portions 20 and 34 may be threaded or may be shaped and sized to form a frictional engagement therebetween.

In addition, portion 34 includes a downwardly extending circumferential channel 37.

The outer member 40 includes cylindrical or frustoconical outer wall 42 with a top lip 44 attaching the outer member 40 to the inner member to form a seal using conventional means, such as an adhesive, ultrasonic welding, frictional interface, etc. For example, the lip 44 may fit into the circumferential channel 37 formed on the portion 34.

The outer member 40 further includes a bottom surface 46 that is flat so that the cup 10 can be rested on a flat surface. In one embodiment, the surface 46 may be joined to the outer wall 42 by a frustoconical wall 48. The outer wall 42 also includes an inner surface 42A and an outer surface 42B.

Figure 3:
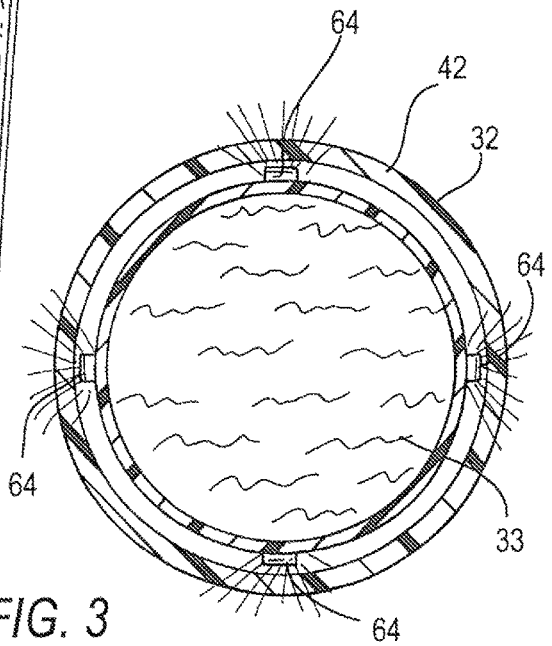
FIG. 3 shows a horizontal cross sectional view of the cup taken along lines 3-3 in FIG. 1.
Figure 2:
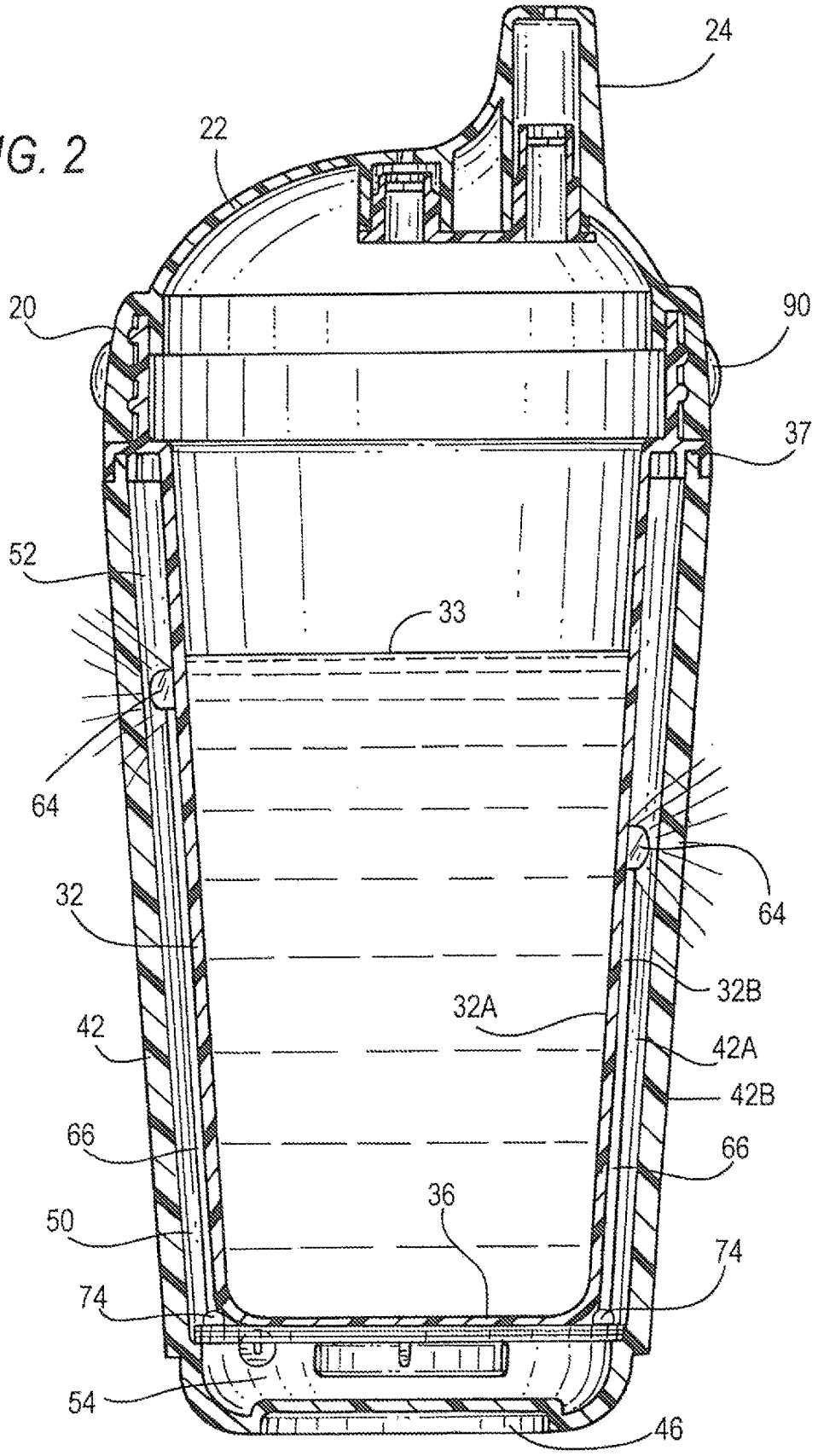
FIG. 2 shows a vertical cross-sectional view of the cup of FIG. 1'.

Preferably the inner and outer members 30, 40 are sized and shaped to form an intermediate cavity 50 therebetween (FIGS. 2 and 3). The seal between the members 30, 40 (formed between the lip 44 of member 40 and channel 37 of portion ring-shaped portion 34) renders this cavity 50 waterproof. Cavity 50 includes two cavity portions: a top portion 52 disposed between frustoconical walls 32, 42 and a disc-shaped portion 54 disposed between bottom surfaces 36 and 46.

Cavity 50 holds an electronic assembly 60 consisting of a disc shaped circuit board 62 (preferably disposed in cavity portion 54) and a first set of light sources 64. In the figures four such light sources 64 are shown disposed at 120 degrees the cavity 52. It should be understood that more or less number of light sources may be used and that these light sources may be at a same height with respect to the circuit board 62, or at different heights.

Light sources 64 are connected to the circuit board 62 by wires 66 to provide power to the sources 64 as described below. The light sources 64 may be supported by the wires 66 within the cavity portion 52 (if the wires 66 are stiff enough) or may be secured to either outer surface 32B of the inner wall 32 or the inner surface 42A of the outer wall 42 by a tape 68 or any other conventional means. The light sources may be preferably colored LEDs.

The circuit board 62 includes a battery 70, an IC 72 and another plurality of light sources 74. The battery 70 and IC 72 cooperate to sense when a predetermined event place takes place, and in response, activate the light sources 64, 74, either simultaneously, or sequentially. In order to preserve power, the activation of the light sources 64, 74 occurs only for a relatively short period, of time, e.g., 3-10 seconds.

FIG. 5 shows an exemplary configuration for the electronic assembly 60. As shown in FIG. 5, the electronic assembly also includes an event sensor switch 76 and a timer 78. The event sensor switch 76 may be implemented in various ways. In one embodiment, the sensor switch 76 is an accelerometer that senses a sudden movement or acceleration of the cub 10. For example, the sensor switch 76 may close when the cup 10 is shaken or placed on relatively hard surface. In another embodiment, the switch 76 is merely a momentary mechanical on/off switch that may or may not be part of the IC 72 or may be mounted on the cup 10 separately and remotely from the circuit board 62.

The closing of switch 76 activates timer 78. The timer 78 in turn sends current to sources 64, 74 thereby causing them to light up. In one embodiment, each light source is lit up for a predetermined time period (e.g., 3-10 seconds as set forth above) and then is shut off. In one alternate embodiment, the light sources 64, 74 all flash several times before being shut off. In FIG. 5, all the light sources are activated simultaneously by timer 78. Alternatively, the light sources 64, 74 can be connected so that they are activated at different times, in sequence. For example, As discussed above, light sources can be white or can have several different colors. In one embodiment, light sources are paired with one light source 64 having the same color as the light source 74 disposed below it on PC board 62.

As discussed above, at least the outer wall 42 is translucent. Preferably, the outer surface of the outer wall 42 is provided with various esthetical designs (not shown) selected especially to please young children. As the light sources are activated they illuminate these esthetic design from the inside in an attractive manner thereby drawing the attention of small children. This effect is further enhanced if the inner wall 42 is also translucent thereby illuminating designs on the inner wall and/or the contents of the cup 10.

In the embodiments described so far and shown in FIGS. 1-4, cup 10 is shown with light source disposed in the cup body 12. However, the light sources may be provided similarly in the top 14 as well, as at 90. The light sources 90 may be activated by electronic assembly 60 through conventional connectors passing current to the top 14. Alternatively, a secondary electronic assembly 92 similar to assembly 60 may be provided to energize and activate sources 90.

Numerous other modifications may be made to the invention without departing from its scope as defined in the appended claims.

I claim:

1. An illuminatable cup assembly, comprising:

an outer member having an outer member base delimiting a first end thereof and an outer member sidewall extending from the outer member base and being delimited at a second end thereof, at least the outer member sidewall being comprised of one of a transparent and a translucent material, an inner member selectively arranged within the outer member and having an inner member base delimiting a first end thereof and an inner member sidewall extending from the inner member base and being delimited at a second end thereof with said inner member sidewall and said inner member base forming a space for holding a product, and a cavity extending between said inner member and said outer member; and an electronic assembly being fully encompassed within said cavity and including a plate that is arranged between said inner member base and said outer member base and that is directly contactable at least with said inner member base, a plurality of first light sources disposed between and attached directly to only one of said inner member sidewall and said outer member sidewall, entirely above and spaced from said inner member base and said plate such that at most said first light sources are in indirect contact with said plate, a plurality of conductors extending outwardly and directly from said plate and connected to said plurality of first light sources, a plurality of second light sources fixed directly to said plate, projecting light at least toward said plurality of first light sources and a power supply connected to said plate and selectively activated to provide power through said conductors to said plurality of first light sources and to provide power to said plurality of second light sources, causing said plurality of first light sources and said plurality of second light sources to light up and thereby become visible outside of said cup assembly.

2. The illuminatable cup assembly of claim 1, wherein said electronic assembly includes an event sensor sensing a predetermined event, said event sensor controlling an activation of said first light sources and said second light sources.

3. The illuminatable cup assembly of claim 2, further comprising a timer coupled to said event sensor and that is responsive to said event sensor to activate said first light sources and said second light sources.

4. The illuminatable cup assembly of claim 1, further comprising an event sensor and a timer coupled to said event sensor, said event sensor selectively activating said first light sources and said second light sources in a predetermined pattern.

5. The illuminatable cup assembly of claim 4, wherein said event sensor includes an accelerometer adapted to sense an acceleration of said cup assembly.

6. An illuminatable container assembly, comprising:

an inner member including an inner member base and an inner member sidewall extending from an outer periphery of said inner member base forming a main cavity for holding a comestible product;

an outer member including an outer member base delimiting a first end thereof and an outer member sidewall extending from the outer member base and being delimited at a second end thereof with at least said outer member sidewall being one of transparent and translucent material, said inner member and said outer member cooperating to form an intermediate cavity disposed between said inner member and said outer member; and an electronic assembly being fully encompassed within said intermediate cavity and including a plurality of light sources attached directly to only one of an outer surface of one of said inner member sidewall and an inner surface of said outer member sidewall and entirely above and spaced from said inner member base and said outer member base and a power source selectively providing power to said light sources with said light sources configured to emit light at least through said outer member sidewall.

7. The illuminatable container assembly of claim 6, wherein said plurality of light sources are a first plurality of light sources that emit light directly outwardly through said outer member sidewall.

8. The illuminatable container assembly of claim 7, wherein said electronic assembly includes a plurality of second light sources disposed entirely within said intermediate cavity, between said inner member base and said outer member base.

9. The illuminatable container assembly of claim 6, further comprising an event sensor arranged and constructed to sense a predetermined event and to cause said light sources to be activated.

10. The illuminatable container assembly of claim 9, wherein said event sensor is an accelerometer arranged and constructed to sense when the container is shaken or placed on a hard surface.

11. The illuminatable container assembly of claim 8, wherein said electronic assembly includes a timer arranged and constructed to activate said first light sources and said second light sources in a predetermined sequence.

12. The illuminatable container assembly of claim 8, wherein said first light sources and said second light sources are colored LEDs.

13. The illuminatable cup assembly of claim 1, further comprising a removable top selectively closing said space.

14. The illuminatable container assembly of claim 7, further comprising a rim joining a top section of said inner and outer members together.

15. The illuminatable container assembly of claim 14, wherein said first light sources are disposed on an outer surface of said inner member sidewall, between said rim and said inner member base.

16. The illuminatable container assembly of claim 6, wherein said power source is disposed between said inner member base and said outer member base.

17. The illuminatable cup assembly of claim 1, wherein the plate has a periphery that is greater than the periphery of said inner member base.

18. The illuminatable cup assembly of claim 1, wherein the plate is a printed circuit board.

* * * * *